US005829603A

United States Patent [19]

Martineau

[11] Patent Number: 5,829,603

[45] Date of Patent: Nov. 3, 1998

[54] PAINT UTENSIL CLEANING CONTAINER

[76] Inventor: Luc Martineau, 8 Richardson, Warwick, Quebec, Canada, J0A 1M0

[21] Appl. No.: 935,020

[22] Filed: Sep. 22, 1997

[51] Int. Cl.[6] ..... A47B 81/02

[52] U.S. Cl. ..... 211/66; 248/110

[58] Field of Search ..... 211/65, 66; 248/110

[56] References Cited

U.S. PATENT DOCUMENTS

| | | | |
|---|---|---|---|
| 288,692 | 11/1883 | Cowley et al. . | |
| 412,461 | 10/1889 | Canon . | |
| 1,629,213 | 5/1927 | Hughes . | |
| 2,278,650 | 4/1942 | Drinkwater . | |
| 2,744,635 | 5/1956 | Hiss . | |
| 2,952,364 | 9/1960 | Jacobson . | |
| 3,141,712 | 7/1964 | Holmes et al. | 211/66 X |
| 3,156,364 | 11/1964 | Wolcott | 248/110 X |
| 4,211,750 | 7/1980 | Gillespie . | |
| 4,627,125 | 12/1986 | Gruns | 211/66 X |
| 4,721,225 | 1/1988 | Sobel | 211/66 X |
| 4,852,833 | 8/1989 | Lockwood | 211/66 X |
| 5,641,007 | 6/1997 | Falk | 211/66 X |

*Primary Examiner*—Blair M. Johnson
*Attorney, Agent, or Firm*—Eric Fincham

[57] ABSTRACT

There is provided a container system for the preservation and soaking of paint utensils and which is suitable for both brushes and paint rollers. The system includes a container preferably of a generally cylindrical configuration and a cover screw threadably engageable at one end thereof. The cover has a roller engaging member extending downwardly while a paint utensil support member is sized to fit within the container. The paint utensil support member has a plurality of hooks extending outwardly therefrom and which are vertically spaced apart to receive a variety of different size paint brushes. The roller engaging member extending downwardly from the cover top wall ensures the securement of a paint roller in a desired position.

6 Claims, 4 Drawing Sheets

PAINT UTENSIL CLEANING CONTAINER

BACKGROUND OF THE INVENTION

The present invention relates to a container for preserving paint brushes and paint rollers.

The concept of utilizing a container for the preservation and soaking of paint brushes or paint rollers is well known in the art. Thus, reference may be had to U.S. Pat. No. 3,185,311 which discloses a paint brush holder wherein the brush is held suspended in the center of a container by means of a member placed across a container top. U.S. Pat. No. 2,952,364 teaches that one may provide a center post which is adjustable in height whereby the brush is held in a vertical position with the bristles being immersed in a solvent at the desired height.

U.S. Pat. No. 5,097,967 teaches a paint brush maintenance device wherein there is provided a brush hanging bar having screw threadably adjustable hooks such that the brush height may be adjusted whereby some brushes may be soaked while other paint brushes are drip drying.

A still further arrangement is shown in U.S. Pat. No. 3,156,364 wherein a plurality of brushes may be suspended from a centrally located support grid.

U.S. Pat. No. 3,918,582 discloses a cylindrical container wherein the container has a wire support including a grid portion and a leg portion for supporting a paint roller cover while also having a horizontal wire rod to support paint brushes.

All of the above devices accomplish the purpose for which they are intended; however a common problem is one wherein the device is suited for different size paint brushes while also being adapted for a paint roller. Such a device should also be inexpensive and easy to manufacture.

When suspending a paint brush for cleaning, it is desirable that only the bristles be maintained in the solvent. As will be appreciated, a number of different sizes of paint brushes may be employed with varying heights.

When soaking a paint roller, it is also desirable that the roller be completely immersed in the solvent while means also be provided for drainage of the paint solids after the brush and/or roller has been cleaned.

SUMMARY OF THE INVENTION

It is therefore an object of the present invention to provide a container for soaking and preserving paint brushes and paint roller covers, and which container is suitable for use with many different size brushes and is simple and economical to manufacture.

According to one aspect of the present invention, there is provided a container system for the preservation and soaking of paint utensils, which system comprises in a container, a cover therefore, and a paint utensil support member. The container has a base, a side wall extending upwardly from the base and with the side wall terminating at a free marginal edge. The free marginal edge thus defines a container mouth. The cover has a cover top wall and a downwardly extending cover side wall, the top wall being sized to cover the container mouth. The roller engaging member extends downwardly from an underside of the cover top wall. A paint utensil support member is sized to fit within the container and has a base and an upwardly extending post. A plurality of hooks extend outwardly from the post with the hooks being vertically spaced apart.

In a greater detail, the container system of the present invention is one which is both inexpensive and suitable for a number of different paint utensils including brushes and rollers.

The paint utensil support member is arranged to seat on the container base while at the same time having a surface which is spaced upwardly from the container base. Apertures are provided in the surface to permit paint and other particles to pass therethrough.

The upwardly extending post is arranged such that a paint roller may fit thereon while also having a plurality of hooks extending outwardly therefrom to receive paint brushes. The hooks are spaced apart in a vertical direction and also preferably in a horizontal direction, such that different size paint brushes may be retained thereon while keeping only the bristles in the solvent.

The cover has a top wall with a roller engaging member extending downwardly therefrom to contact one end of a roller placed about the post. This prevents the roller from floating upwardly out of the solvent.

The container system and its various components may be made of various materials; a plastic material is preferred for both ease of manufacture and cost thereof. A portion of the side wall of the container may be transparent in order to permit visual inspection.

In a further aspect of the present invention, there is provided an embodiment wherein the paint utensils support member, in a first variation, is designed to support a paint roller and through the use of an adaptor, is also designed to support paint brushes.

BRIEF DESCRIPTION OF THE DRAWINGS

Having thus generally described the invention, reference will be made to the accompanying drawings illustrating an embodiment thereof, in which.

DESCRIPTION OF THE PREFERRED EMBODIMENTS

Figure 1:
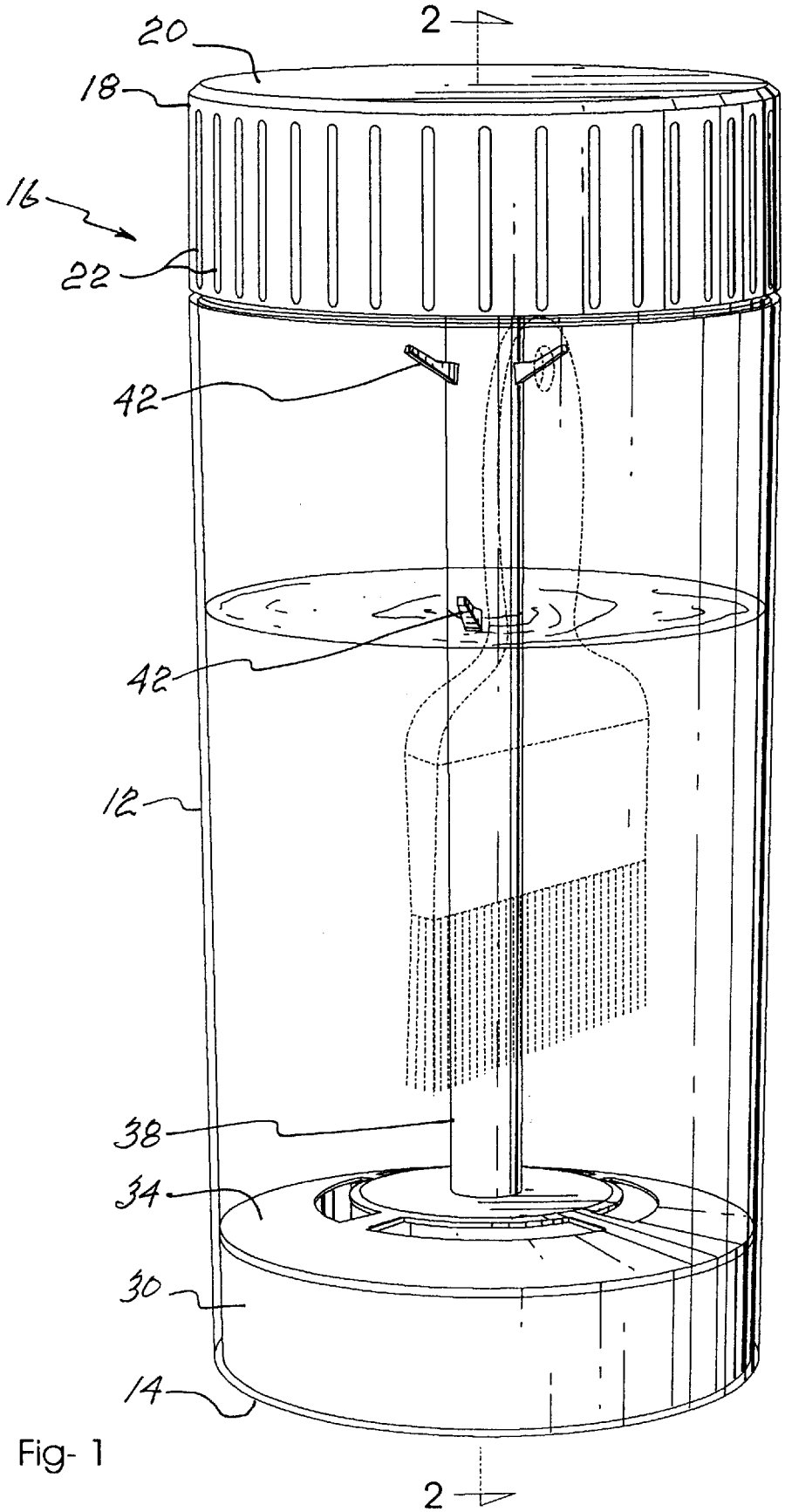
FIG. 1 is a perspective view of a container according to the present invention having a paint brush located therein.

Referring to the drawings in greater detail and by reference characters thereto, there is illustrated in FIG. 1 a container which is generally designated by reference numeral 10 and which container has a cylindrical side wall 12 and a base 14.

A cover 16 having a top wall 20 and a downwardly depending side wall 18 is screw threadably engaged with upper portion of cylindrical side wall 12. A plurality of ribs 22 are provided on an exterior surface of cover side wall 18 to aid in gripping thereof. Located centrally of top wall 20 and extending downwardly is a cylindrical projection 24.

Sized to be mounted inwardly of container 10 is an insert generally designated by reference numeral 28 and which insert has a side wall 30 and a base 32. Extending upwardly from an upper edge of side wall 30 is a sloping upper wall 34 which contains a plurality of apertures 36 therein.

Insert 28 includes a center post 38 having a handle 40 formed at the upper distal end thereof. Extending outwardly from center post 38 are a plurality of pegs 42, the pegs being located at different and varying heights.

Figure 2:
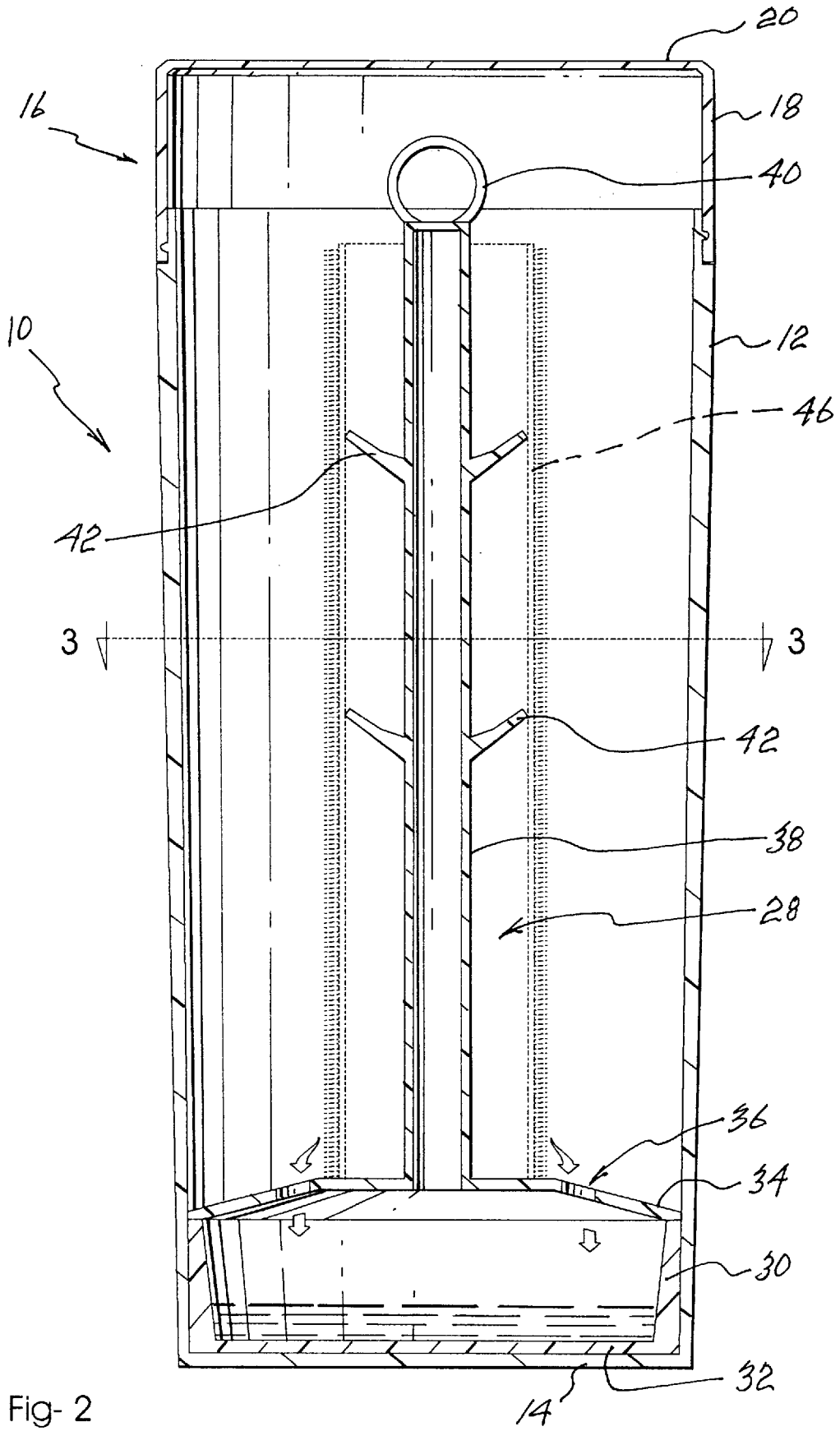
FIG. 2 is a side sectional view thereof.
Figure 3:
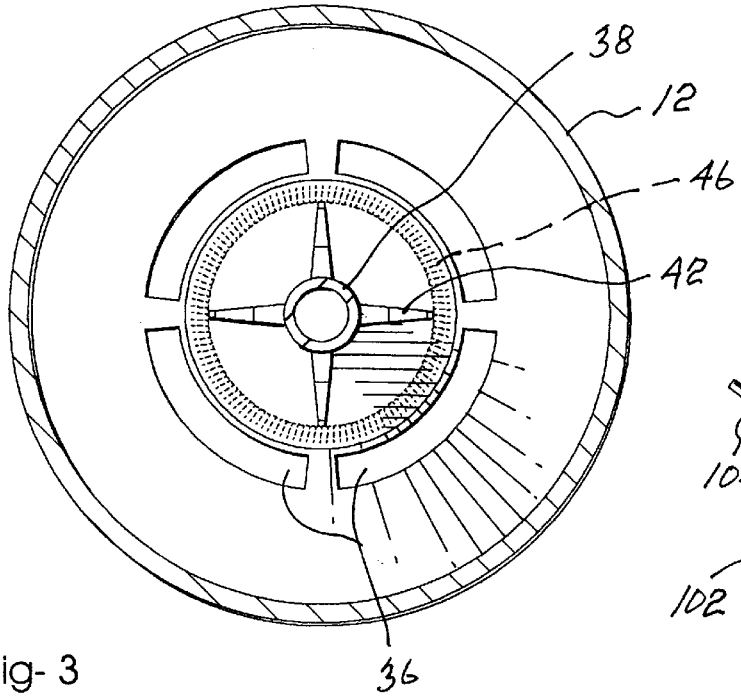
FIG. 3 is a cross sectional view taken along the lines 3—3 of FIG. 2.

In use, and as shown in FIGS. 2 and 3, a paint roller generally designated by reference numeral 46 may be inserted within container 10 over center post 38 such that the bottom of paint roller 46 rests on upper wall 34. The container may be filled with the solvent for the paint utilized and frictional engagement with pegs 42 ensures that the paint roller 46 remains in the solvent. As shown in FIG. 2, dissolved paint solids are free to pass through apertures 36.

As illustrated in FIG. 1, paint brushes 48 may be suspended from pegs 42 to maintain their bristles in the solvent.

Figure 5:
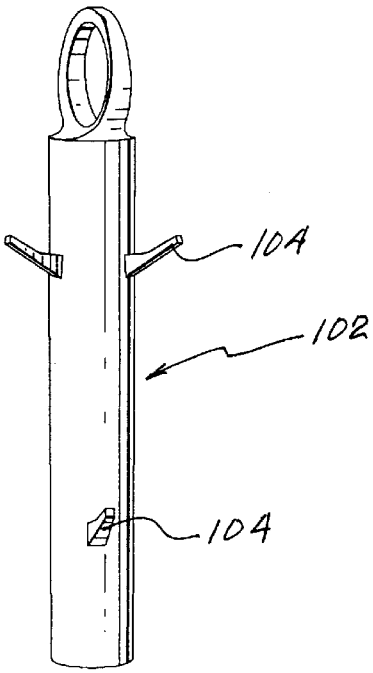
FIG. 5 is a side elevational view of an adaptor for use with the embodiment of FIG. 4.
Figure 6:
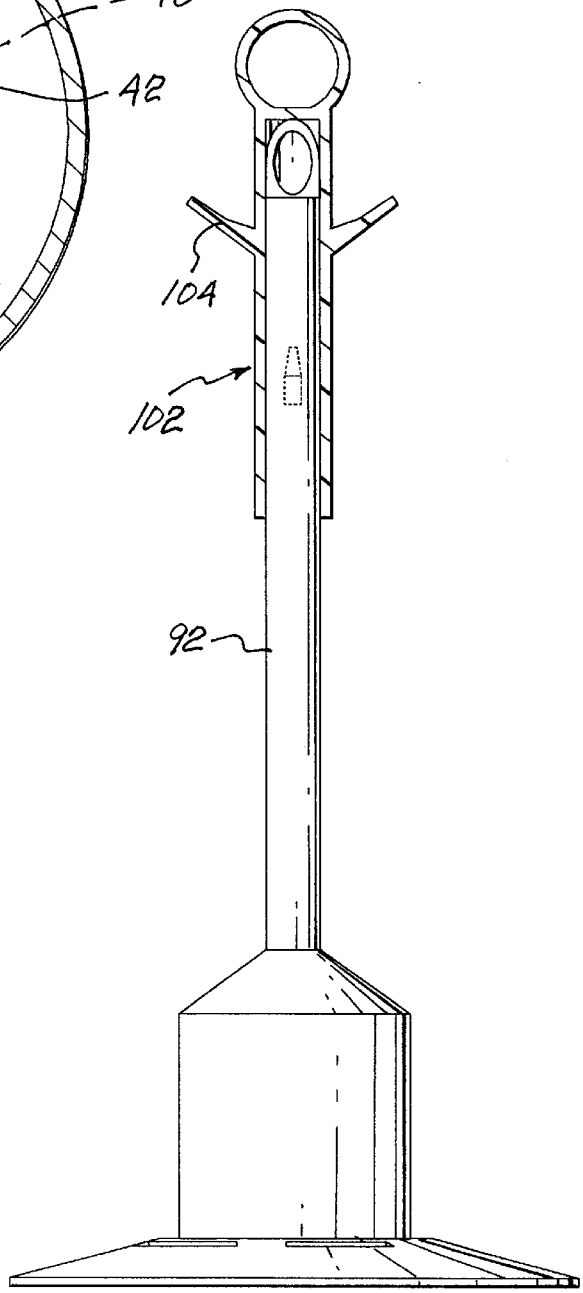
FIG. 6 is a side elevational view illustrating use of the adaptor of FIG. 5.
Figure 4:
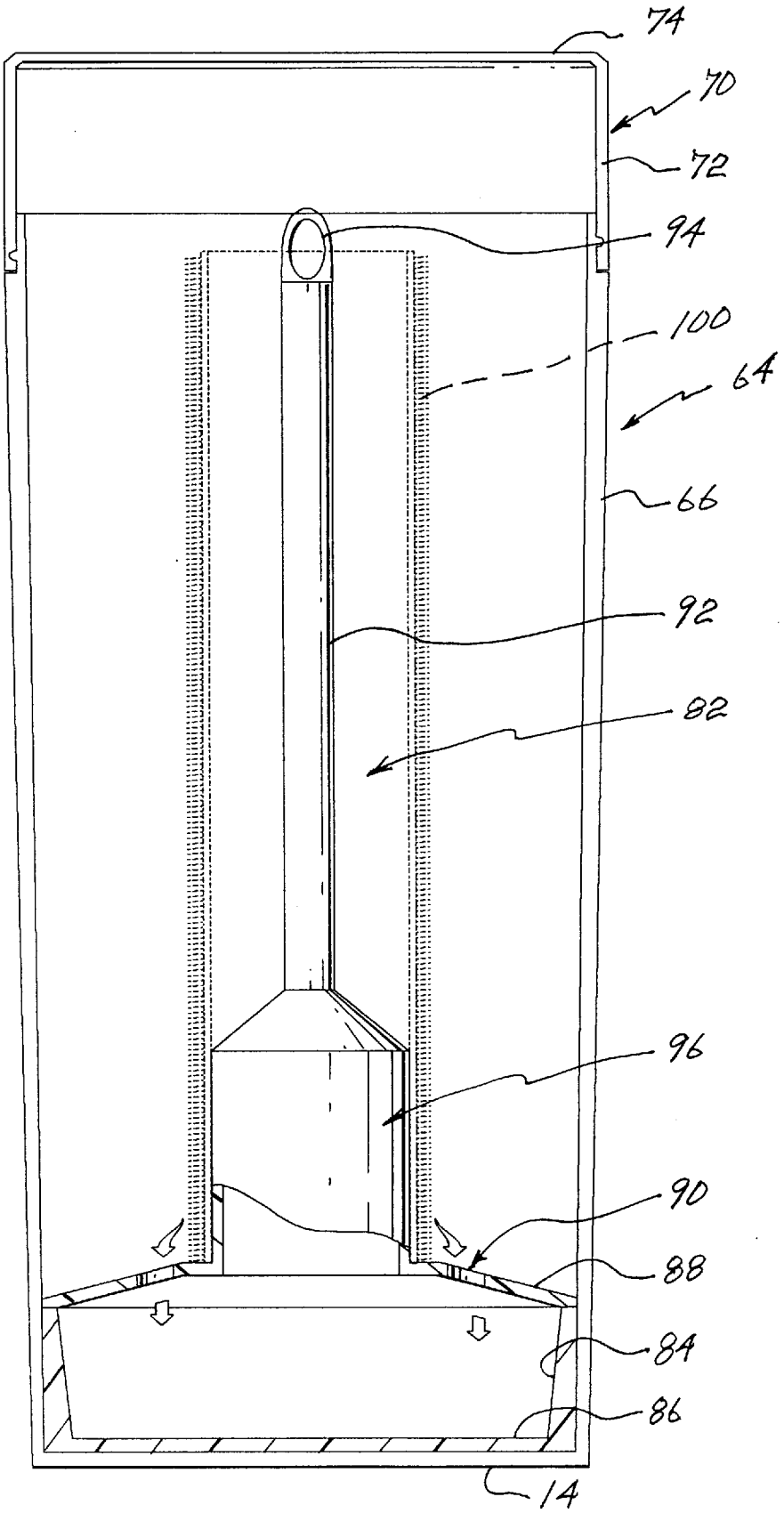
FIG. 4 is a side sectional view illustrating a modified embodiment of the present invention.

Turning to the embodiment of FIGS. 4 to 6, there is illustrated a container 64 having a cylindrical side wall 66 and a bottom wall 68. A cover 70, as in the previous embodiment, has a top wall 74 with a downwardly depending side wall 72.

Insert 82 has a bottom portion with a side wall 84 and a bottom wall 86. A sloping upper wall 88 has apertures 90 formed therein.

Extending upwardly is a center post 92 having a handle 94 at its distal end. An enlarged bottom portion 96 is adapted to frictionally receive and retain paint roller 100. In this embodiment, it is not required that the center of the cover retain the paint roller 100 in a.

For paint brushes, an adaptor 102 having pegs 104 extending outwardly therefrom may be designed to fit over center post 38 as shown in FIG. 6.

It will be understood that the above described embodiment is for purposes of illustration only and that changes and modifications may be made thereto without departing from the spirit and scope of the invention.

I claim:

1. A container system for the preservation and soaking of paint utensils:

a container having a base, a side wall extending upwardly from said base, said side wall terminating at a free marginal edge, said free marginal edge defining a container mouth;

a cover having a cover top wall and a downwardly extending cover side wall, said cover top wall being sized to cover said container mouth; and a paint utensil support member sized to fit within said container, said paint utensil support member having a base portion and an upwardly extending post, a plurality of vertically spaced hooks extending outwardly from said post, said support member having means for frictionally retaining a paint roller wherein said base portion of said paint utensil support member includes a base portion side wall, and a base portion upper wall extending inwardly from said base portion side wall to said post, said base portion upper wall having a plurality of apertures therein.

2. The container system of claim 1 wherein said container, said cover and said paint utensil support member are made of a plastic material.

3. The container system of claim 1 wherein at least a portion of said side wall of said container is of a transparent material.

4. The container system of claim 1 wherein said hooks extending outwardly from said post are spaced circumferentially around said post.

5. The container system of claim 4 further including a handle portion located at a distal end of said upwardly extending post.

6. The container system of claim 1 wherein said cover side wall is screwed threadably engageable with said container side wall.

* * * * *